US005988637A

United States Patent [19]

Dickerson

[11] Patent Number: 5,988,637

[45] Date of Patent: Nov. 23, 1999

[54] BALL RELEASE APPARATUS FOR BALLS WHICH ARE ROLLING PLAY OBJECTS AND DISPENSED AS PRIZES

[76] Inventor: Lyle G. Dickerson, 345 W. 17th St., Idaho Falls, Id. 83402

[21] Appl. No.: 08/962,292

[22] Filed: Oct. 31, 1997

Related U.S. Application Data

[63] Continuation-in-part of application No. 08/742,656, Nov. 4, 1996, Pat. No. 5,722,656.

[51] Int. Cl.[6] ..... A63F 7/02

[52] U.S. Cl. ..... 273/118 R; 273/119 R; 273/121 R

[58] Field of Search ..... 273/108, 118 R, 273/118 A, 119 R, 119 A, 121 R, 121 A, 122 R, 122 A, 123 R, 123 A, 124 R, 124 A, 125 R, 125 A; 221/277

[56] References Cited

U.S. PATENT DOCUMENTS 2,003,349 6/1935 Dumble .
2,103,744 12/1937 Dumble .
3,814,429 6/1974 Lienhard .
3,899,170 8/1975 Parks et al. .
4,235,438 11/1980 Hally .
4,322,082 3/1982 Peters .
5,722,656 3/1998 Dickerson ..... 273/118 R

*Primary Examiner*—Raleigh W. Chiu

[57] ABSTRACT

In a machine to dispense balls (spherical or near-spherical objects such as gumballs) wherein means is provided to play a game with one of the balls before it is dispensed, a temporary holding chamber is provided for a ball by two blades of a paddle-wheel-like wheel which coact with stationary surrounding side members. A latch engages a wheel portion to prevent the wheel's rotation except in response to the actuation of a target by a rolling ball in play on a playfield. By providing such a chamber in this manner, unwanted release of a ball in response to even extreme tilting or shaking of the machine is prevented because the apparatus can easily be made so that no amount of shaking or tilting will change the characteristics of the chamber to make it possible for a ball to exit the chamber except in response to actuation of the latch.

7 Claims, 8 Drawing Sheets

BALL RELEASE APPARATUS FOR BALLS WHICH ARE ROLLING PLAY OBJECTS AND DISPENSED AS PRIZES

CROSS- REFERENCE TO RELATED APPLICATION

This application is a Continuation-in-Part Application of my application entitled MACHINE TO PLAY GAME WITH ROLLING BALLS AND DISPENSE THE BALLS AS PRIZES filed Nov. 4, 1996, which became Application No. 08/742,656 now U.S. Pat. No. 5,722,656.

BACKGROUND OF THE INVENTION

1. Field of the Invention

The invention relates to apparatus in a machine to dispense gumballs or other near spherical objects from a reservoir wherein a game is played with one of the balls as a rolling play object prior to its being dispensed and another one of the same balls is dispensed as a prize for success in playing the game. The apparatus provides for release of balls from a temporary holding chamber in such manner as to prevent disruption of the release protocol by tilting or shaking of the machine.

2. Description of Related Art

The following patents show a mechanism in a vending device which has a configuration which appears to resemble a paddle wheel or a portion of a paddle wheel.

Some of these patents describe an amusement device or disclose devices which have both an amusement function and a dispensing function. In many the amusement feature involves playing a game and in some the game is played with a rolling ball on a sloping playfield.

But the patents and other disclosures discussed below do not show the object which is awarded as a prize for ability in playing the game as being first used as a projectile in playing the game and especially not as a rolling ball type of projectile in the playing of the game. None shows the vending of the playing pieces, either as the principal object to be achieved by the user in response to insertion of a coin or as prizes or both.

2,003,349 issued Nov. 23, 1933 to Dumble 2,103,744 issued Dec. 28, 1937 to Dumble 3,814,429 issued Jun. 4, 1974 to Lienhard 3,899,170 issued Aug. 12, 1975 to Parks 4,235,438 issued Nov. 25, 1980 to Hally 4,322,082 issued Mar. 30, 1982 to Peters The first Dumble patent shows in FIGS. 3 and 4 a single blade 90 mounted rotatably on a horizontal axis to receive a ball through aperture 40 whereby it is moved rotatably to the position shown in full lines in FIG. 4 whereby blade 90 then supports the ball as shown in dashed lines in FIG. 4.

When it is desired to release the ball the plate 40 is moved (without rotation) slidably to the left to cause the mechanism to occupy the position shown in dashed lines at 93 in FIG. 4 and allow the ball to drop through tube 92. The mechanism may then be reset by moving plate 40 slidably to the right so that member 90 rotates in the opposite direction (counter clockwise) to the position which it originally occupied in FIG. 3.

The first Dumble patent shows also the vending of a mint candy (column 1, line 49) in response to inserting a coin combined with making the pinball playfield available to the player but the mint candy is not dispensed in response to achieving some pinball score nor is another candy available until another coin is inserted.

The second Dumble patent shows an identical or nearly identical mechanism.

The Lienhard patent shows a target mechanism which includes two blades 23 and 24 extending at about 90 degrees to each other from a horizontal pivot wire 21. When the target leaf 24 is struck by a flying projectile, the blades are rotated clockwise from the position shown in FIG. 3 to the position shown in dashed lines in FIG. 4 whereupon the device is retained in this position by the action of magnet 28 on armature 27 which is attached to blade or leaf 24.

The blades are reset to the position shown in FIG. 23 by rotation of pivot wire 21 to move them rotatable in the opposite direction (counter clockwise).

The patents issued to Parks, Hally and Peters show wheels mounted rotatably to rotate on horizontal axes wherein the wheels each have blades extending therefrom. But in each case there are just two blades. And the wheels serve no purpose other that to provide extending blades or leaves which may be struck by projectiles.

Thus, in none of these disclosed mechanisms does a ball rest at any time in supported relationship on a laterally extending blade.

None of these patents shows the vending as prizes of balls from the same reservoir as the playing pieces.

None of the patents or other disclosures discussed above suggests or teaches the claimed invention.

SUMMARY OF THE INVENTION

The apparatus of the invention constitutes a portion of a machine which comprises a source, such as a reservoir, to hold spherical or near-spherical objects such as gumballs or the like, the reservoir being in upwardly spaced relation to a sloping playfield onto which the objects can be dropped.

All of such objects, which are best described as objects chosen from the group consisting of spherical and near-spherical objects, will be often referred to hereinafter as "balls" and it is to be understood that by this term it is meant to include all spherical and near-spherical objects which may be conceived for use in the machine provided that they are suitable for being awarded as prizes. Thus the large steel balls which are conventionally used in pinball machines are not to be considered as being included and neither are the small steel balls conventionally used in pachinko machines. Balls which are suitable for use in the machine of the invention include preferably gumballs or balls which have an exterior shell comprising relatively hard or strong plastic with a small article contained in the interior which may be a trinket or toy. Such an article may be a miniature flag, a small toy truck, a paper card or scroll bearing indicia such as a poem or a verse from the bible, or the like. Other balls which may be suitably used in the machine may be balls of hard candy or rubber balls or other balls of a firm elastic material.

In the machine, means are provided to receive coins and to separate one of the balls from the number contained in the reservoir and cause it to be dropped onto the playfield in response to receiving a coin and means are provided for the player to then attempt to drive the ball, which may be referred to as the "play-ball", into contact with a target which in turn is disposed to cause another of the balls contained in the reservoir to be dispensed as a prize. The machine is arranged so that the play-ball may fall through a hole in the playfield and be dispensed before hitting the target and so that if it hits the target, it is then dispensed and can be played with no longer.

The apparatus of the invention constitutes part of the mechanism which provides for the prize ball to be dispensed and is characterized by having a "paddle-wheel-like" configuration wherein the "paddle wheel" rotates on a horizontal axis. One blade of the "paddle wheel" is maintained in a horizontal or near-horizontal position by a latch mechanism which prevents the rotation of the "paddle wheel" in the direction urged by the gravitational force of one of the balls being supported on that blade. The blade constitutes the bottom of a supplementary chamber provided, below and in communication with the reservoir, by said blade as the bottom, by another blade as one side, and by three stationary members as the other three sides. The latch is released when the target is struck, thereby permitting the "paddle wheel" to rotate into a subsequent position in which rotation is again prevented by the re-engagement of the latch, and during the rotation of the wheel the ball which rests on the blade is dropped into a position from which it is dispensed.

Embodiments may be provided in which more than one of the balls may be provided as prizes.

DESCRIPTION OF THE PREFERRED EMBODIMENTS

Figure 1:
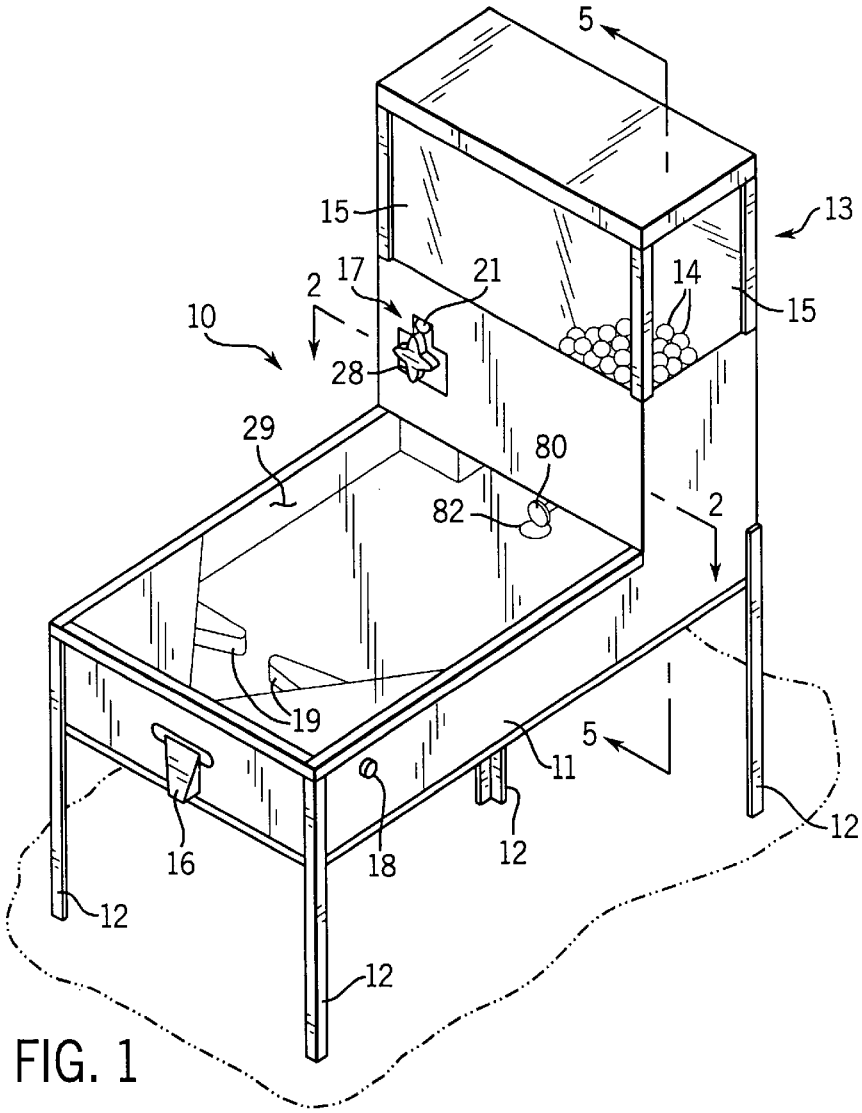
FIG. 1 is a perspective view of a preferred embodiment.

Referring now to FIG. 1, the main body 11 of the device indicated generally as 10 may be supported on legs 12 and be provided with a reservoir or tank 13 which may hold a plurality of spherical or near-spherical objects such as gumballs 14. As alternatives to gumballs, objects such as balls of hard candy, capsules which contain miniature toys or flags or decorations, rubber balls or the like may be provided, all of which are suitable for being awarded as prizes.

As mentioned above, such objects which are best described as objects chosen from the class consisting of spherical and near-spherical objects will be generally referred to hereinafter as "balls" and it is to be understood that by this term it is meant to include all spherical and near-spherical objects which may be conceived for use in the device provided that they are suitable for being awarded as prizes.

The sides 15 of reservoir 13 may be transparent.

To dispense a ball it is introduced to the area behind cover 16 which may then be lifted by a user to obtain the ball, after first completing several previous steps.

Coin receipt and initiation of operation of the machine is the function of the mechanism indicated generally as 17 which may comprise rotatable knob 28 and a recessed coin slot 21 (FIG. 3) to receive a coin thereinto. When a coin of the proper size is introduced into device 17, rotation of knob 28, which is prevented from rotating in the absence of a coin, is enabled and it may then be rotated by hand, thereby causing the coin to drop into coin box 9 (FIGS. 3 and 4) and causing a ball 14*c* to drop onto surface 26 of playfield 27 as described hereinafter.

Buttons 18 may be provided to operate flippers 19 seen through transparent cover 29. As shown in FIGS. 18, 21, 22 and 23 of the parent application, referred to above, the flippers may be operated by application of electricity. They may also be operated by suitable mechanical linkages.

Figure 2:
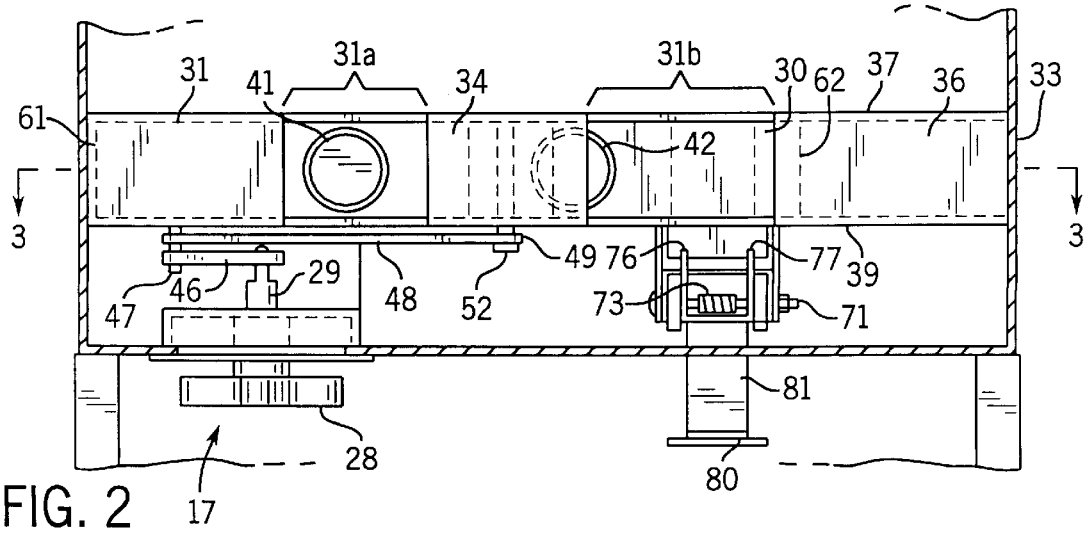
FIG. 2 is a fragmentary sectional plan view taken on line 2—2 in FIG. 1 which shows the mechanism below the reservoir which is disposed to separate objects from those in the reservoir and make them available to be dropped onto the playfield to serve as play pieces.
Figure 3:
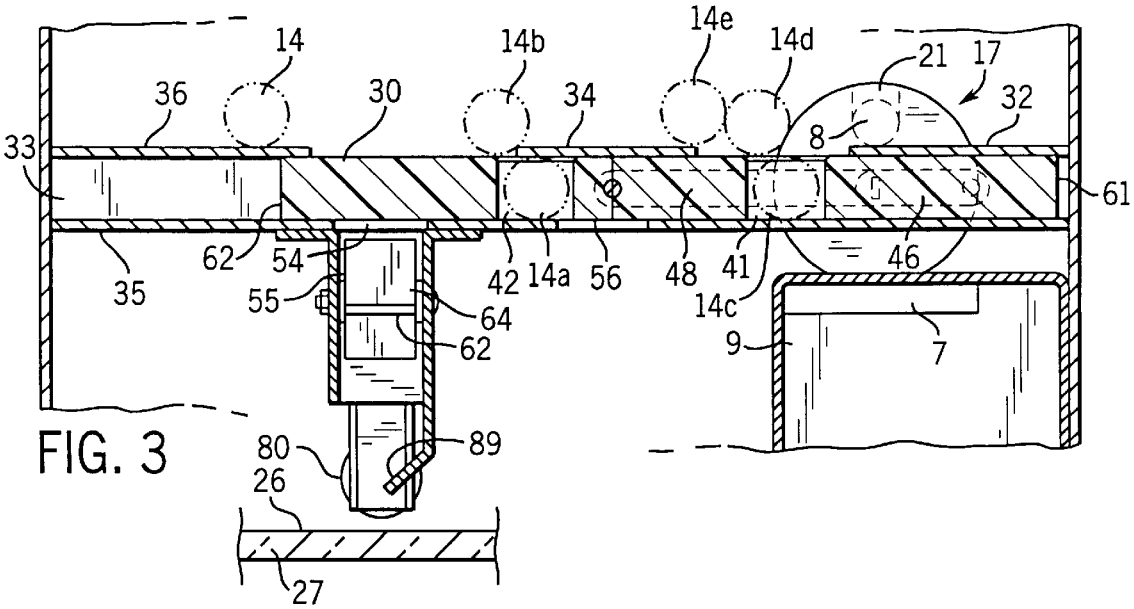
FIG. 3 is a cross sectional elevation from the rear of the mechanism of FIG. 2 taken on lines 3—3 in FIG. 2.
Figure 4:
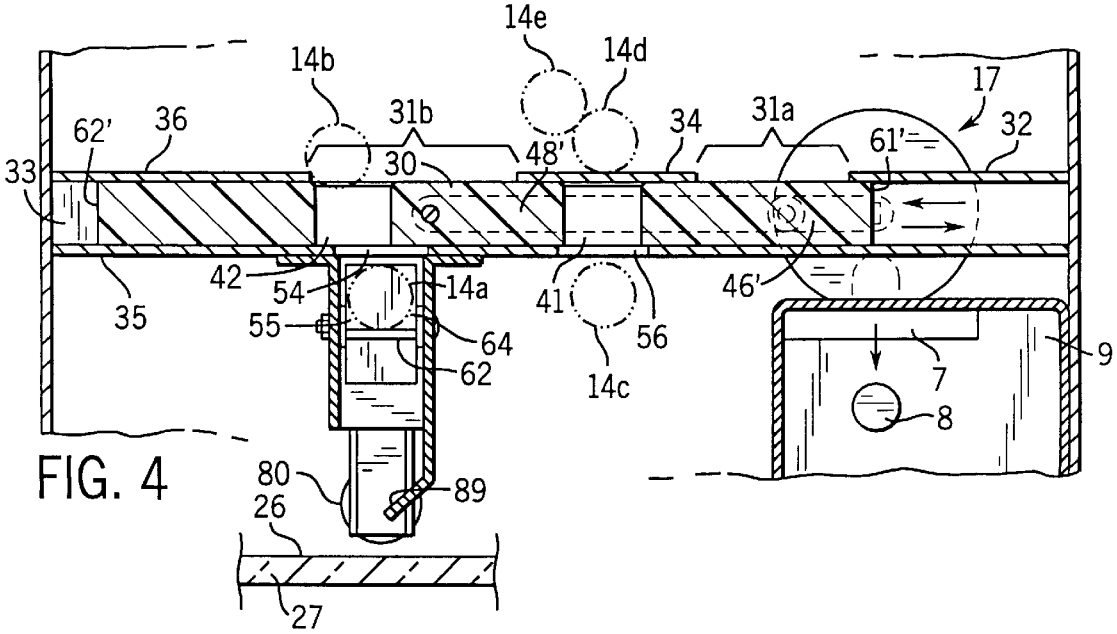
FIG. 4 is a view from the same aspect as FIG. 3 but with the mechanism in a different position.
Figure 8:
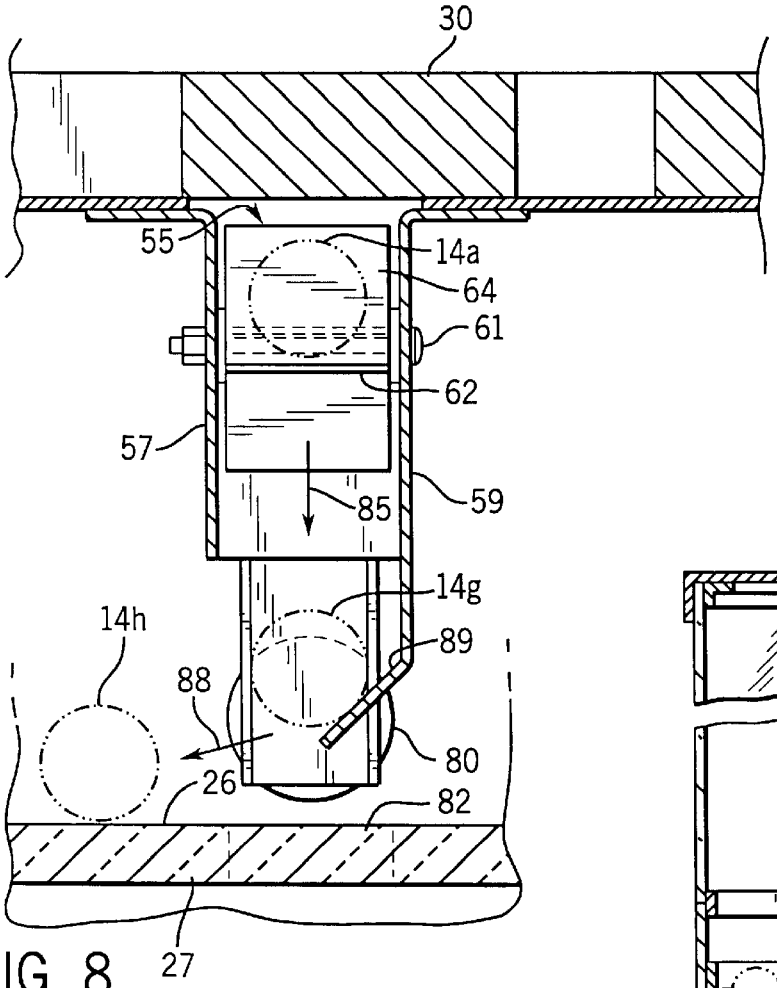
FIG. 8 is a partially cross sectional cut-away elevation taken on lines 8—8 in FIG. 7.
Figure 5:
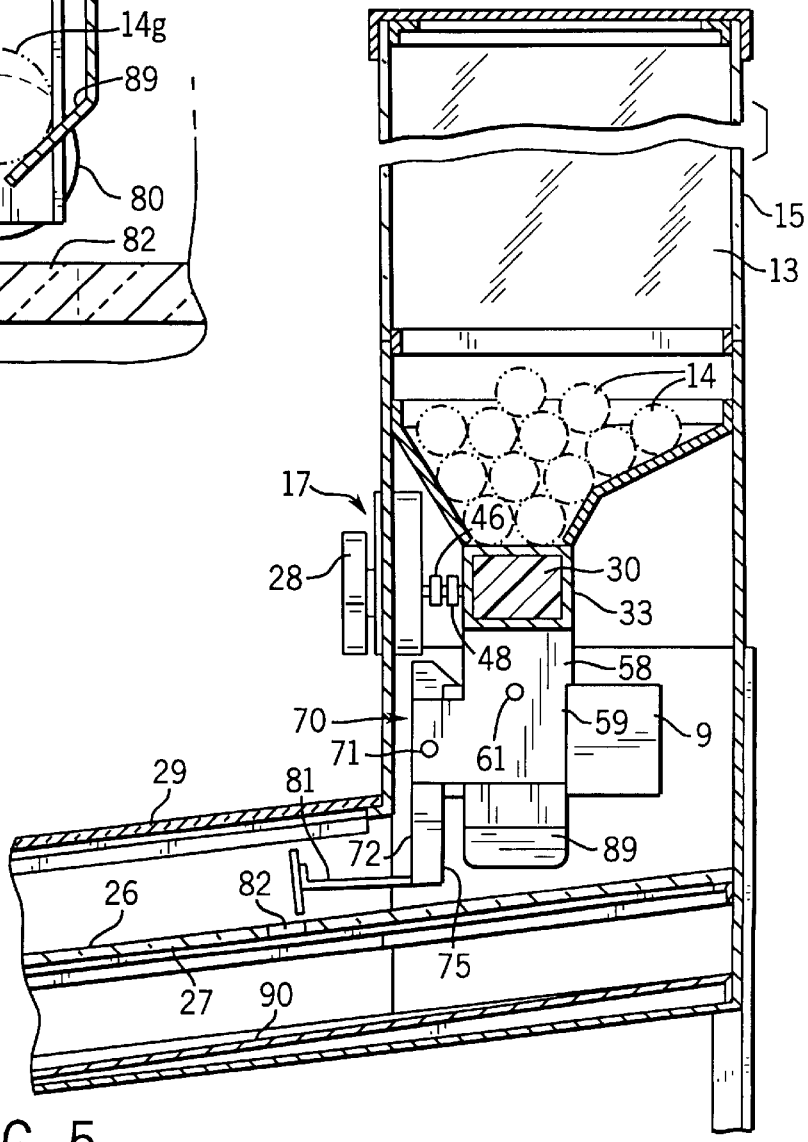
FIG. 5 is a fragmentary cross sectional elevation taken on lines 5—5 in FIG. 1.

Referring now to FIGS. 2, 3 and 4 there is shown a slide bar 30 of plastic slidably received in a rectangular channel or tube indicated generally as 33 which may be defined by a bottom portion 35, a discontinuous top comprising end portions 32 and 36 and middle portion 34 which are parts of the bottom of reservoir 13 and are separated by openings 31*a* and 31*b* in the bottom of reservoir 13 and by side portions 37 and 39 (FIG. 2). The openings 31*a* and 31*b* on each side of middle portion 34 allow balls 14 to communicate therethrough with the top of slide bar 30 and respectively with the cylindrical chambers 41 and 42 which are provided in bar 30.

Slide bar 30 may be provided as a member of solid plastic, as shown, of a is material such as polyethylene, polypropylene or a polymer of tetrachloroethylene such as Teflon, with chambers 41 and 42 machined into the part, or may be made as an iniection molding with chambers 41 and 42 molded into the part or may be made as an assembly of pieces cemented together. Slide bar 30 may be made of metal. The wall portions 32, 34, 35, 36, 37 and 39 of tube 33 are preferably made of stainless steel or other acceptable food grade material as will be discussed further hereinafter.

Chambers 41 and 42 are shown as cylindrical but may have any one of many polygonal forms. Thus, although the cylindrical shape is preferred, they may he hexagonal or square.

Coin mechanism 17 is conventional and for simplicity its internal mechanism is not shown. It provides a somewhat recessed coin slot 21 (FIG. 3) to receive a coin and provides means to accept or reject coins and provides for coins which are accepted to drop into coin box 9 as indicated in FIG. 4 for coin 8 which drops into coin box 9 as shown.

Knob 28 is attached to one end of shaft 29 of which each end extends outwardly from coin mechanism 17. Affixed to the end of shaft 29 opposite to knob 28 is crank 46 which is hingingly attached by crankpin 47 to connecting rod 48 which is hingingly attached at its opposite end 49 to pin 52 received in bar 30.

Reciprocating motion of slide bar 30 is achieved by rotation of knob 28 which is affixed to shaft 29 whereby slide bar 30 is reciprocated slidingly in tube 33.

Thus slide bar 30 is at its point of maximum travel in one direction in FIGS. 2 and 3 as indicated by the positions of ends 61 and 62 of slide bar 30 in those figures and by the overlapping relation of crank 46 and connecting rod 48 in those figures. Slide bar 30 is at its point of maximum travel in the other direction in FIG. 4 as indicated by the positions of ends 61 and 62 at 61' and 62' in that figure and by the extended in-line relation of crank 46 and connecting rod 48 as shown at 46' and 48'.

A ball 14*a* may enter chamber 42 from reservoir 13 because of its own weight and that of balls above it such as ball 14*b*. Likewise ball 14*c* may enter chamber 41 because of its own weight and that of balls above it in reservoir 13 as indicated by balls 14*d* and 14*e* (FIG. 3).

When bar 30 is at the other end of its stroke (FIG. 4), a ball such as ball 14*a* may fall from chamber 42 into temporary holding chamber 55 and at the same time a ball such as ball 14*c* may then fall out of chamber 41 on to surface 26 of playfield 27 but the following balls 14*d* and 14*e* are prevented from entering chamber 42 by middle portion 34 of the upper wall of tube 33 and cannot enter chamber 42 until bar 30 again approaches the other end of its stroke as shown in FIG. 3.

Located immediately below tube 33 and communicating therewith through opening 54 in the bottom wall 35 of tube 33 is secondary holding chamber 55 which may receive ball 14*a* from chamber 42 through opening 54.

Another opening 56 in the bottom wall 35 of tube 33 provides direct communication from chamber 41 to the space above playfield surface 26.

The chamber 42 in slide bar 30 and secondary holding chamber 55 are so dimensioned that a ball contained in chamber 42 in slide bar 30, when passed over secondary holding chamber 55 will fall into it if it is empty and will pass over it if it has a ball in it. The ball in the upper chamber 42 simply slides or glides over the ball in the lower chamber.

For purposes of explanation, if it is assumed that secondary holding chamber 55 is empty and the slide bar 30 is moved from its position shown in FIGS. 2 and 3 to the position of FIG. 4, chamber 42 in slide bar 30 will pass over chamber 55 and on the return stroke chamber 42 will again pass over chamber 55 thus providing two opportunities for a ball such as ball 14*a* to fall into chamber 55 thereby assuring that chamber 55 will not remain empty after bar 30 has traveled through a full stroke. Meanwhile chamber 41 will have received a ball 14*c* from reservoir 13 as indicated in FIG. 3 and as chamber 41 passes over hole or opening 56, that ball will be dropped directly from chamber 41 through opening 56 onto playfield surface 26. At the same time middle portion 34 overlying chamber 41 at this point prevents any other ball from the reservoir from entering chamber 41 and then following the first ball in dropping to the playfield.

To initiate the process of dispensing a ball (or in more common language, to start playing the game) the tiser or player may put a coin into coin slot 21 (FIG. 3) of mechanism 17 to allow knob 28 to be turned and may then turn knob 28 through a full 360 degrees of rotation to cause bar 30 to be reciprocated through a full stroke whereupon the ball 14*c* in chamber 41 falls through opening 56 onto the playfield surface 26.

As shown in FIGS. 2, 3, 4, 5, 6, 7, and 8, secondary holding chamber 55 is provided by stationary vertically extending sides 57, 58 and 59 and by a horizontal or near horizontal leaf or blade 62 and a vertical or near-vertical leaf or blade 64 of wheel 60. Wheel 60 is mounted to rotate on a horizontal or near-horizontal axis which may be the axis of pin 61 and is provided with a plurality of leaves or blades, which may be four in number as shown.

Washers 57*a* and 59*a* may be received on pin 61, between the ends of wheel 60 and stationary sides 57 and 59. As an alternative to providing stationary sides 57 and 59 as sides of chamber 55, the diameters of washers 57*a* and 59*a* may be increased so that they extend outward as far as the ends of the blades 62, 64 and 66. They may then rotate with wheel 60 and thus provide rotating sides of chamber 55 in place of sides 57 and 59.

Figure 7:
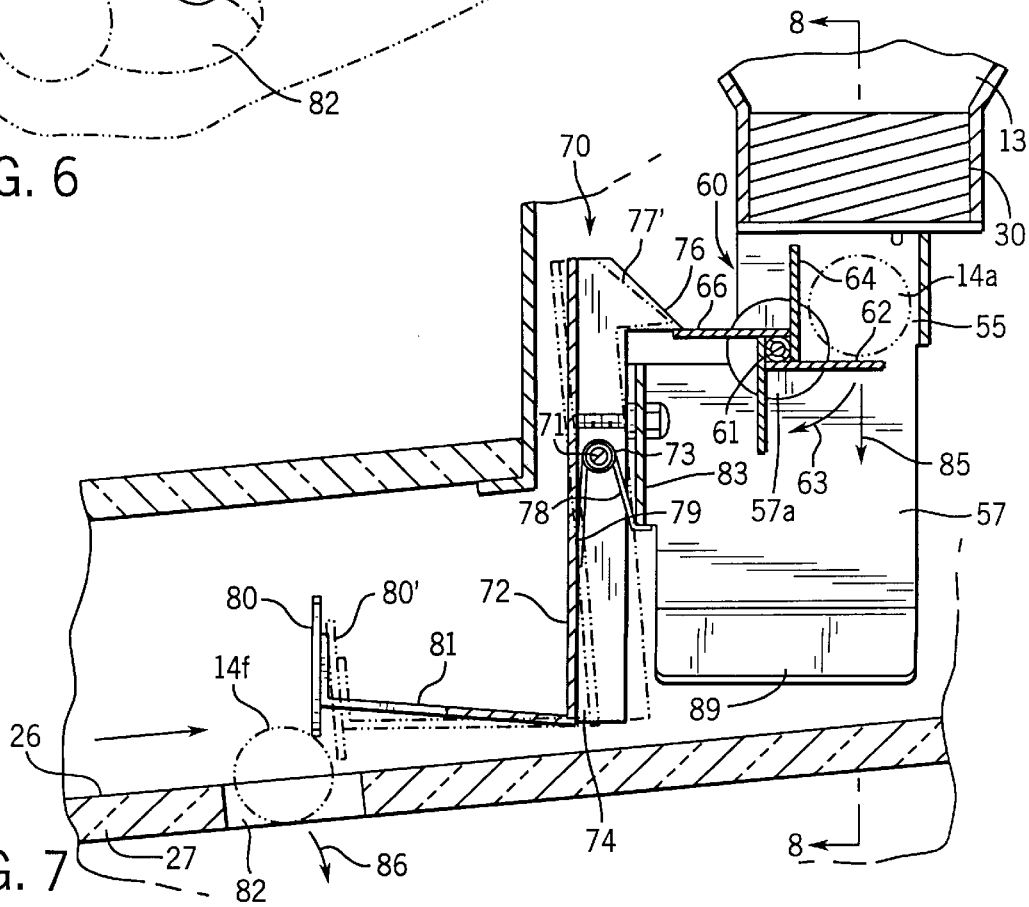
FIG. 7 is a cross sectional elevation taken on lines 7—7 in FIG. 6.

The gravitational force acting downwardly on leaf 62 because of the weight of the ball 14*a* which it supports urges the wheel to rotate in the direction shown by arrow 63 in FIG. 7. Such rotation is prevented by the latch member indicated generally as 70 and comprising side members 74 and 75 which in turn are provided with extending teeth portions 76 and 77 which engage with blade or leaf 66 which extends oppositely to blade 62. Latch 70 is mounted to rotate on horizontally extending pin or bolt 71 which may be supported by extending portions of sides 57 and 59 as shown. Latch 70 may have a back portion 72 from which its sides 74 and 75 may extend. Also extending from back portion 72 there may be provided a target support member 81 to which target 80 may be attached. Target 80 may be a flat piece of plastic or metal located near the playfield surface 26 and normal or nearly normal thereto. A hole or opening 82 in the playfield is preferably provided below and in front of the target as shown.

Figure 6:
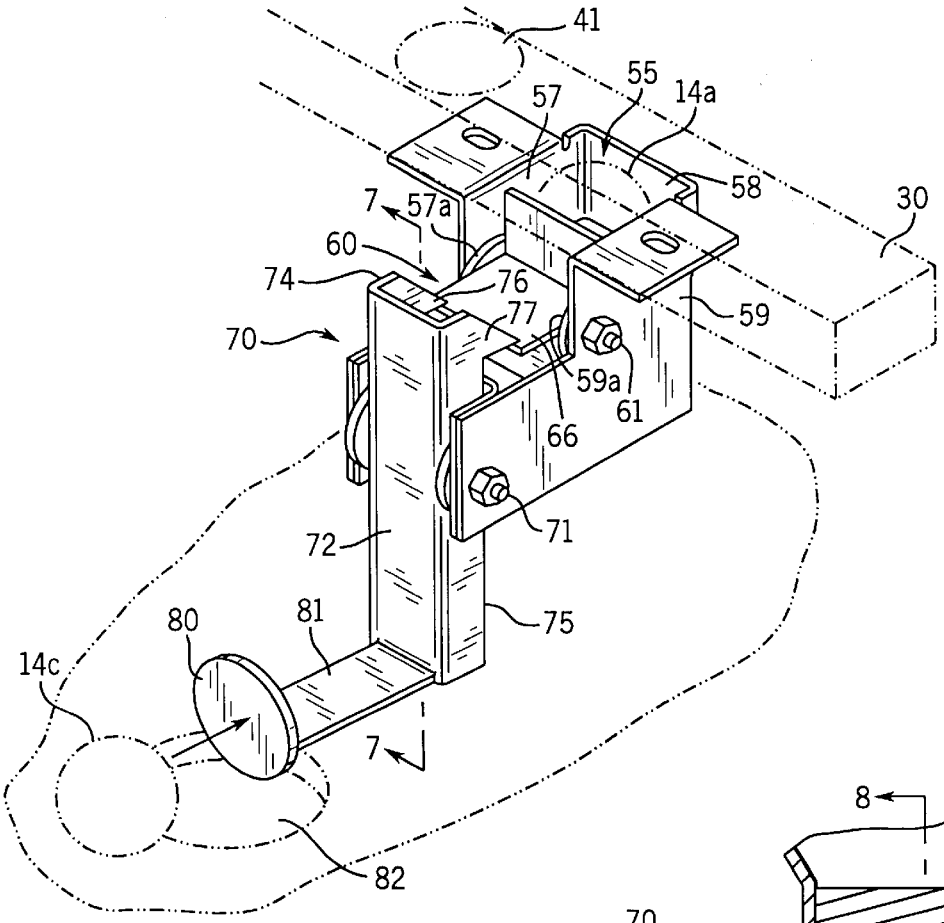
FIG. 6 is a cut-away perspective view of the mechanism of the invention as shown in elevation in FIG. 5.

When a ball, as indicated at 14*c* in FIG. 6 is driven toward target 80 and then hits it, it causes target 80 to move to the position indicated at 80' thus moving latch 70 against the resistance of spring 73 provided as a coil surrounding pin 71 with extending arms 79 and 78 acting respectively against back 72 and reaction member 83, which may be fastened to sides 57 and 59, so that latch 70 is moved to the position indicated at 70' and teeth 76 and 77 are moved to the position shown at 77' and thereby disengaged with blade 66 whereupon the ball shown at 14*a* drops as indicated by arrow 85 while wheel 60 rotates as indicated by arrow 63.

At the same time the ball indicated at 14*c*, after striking target 80, falls into hole 82 as indicated at 14*f* and through it as indicated by arrow 86 whereby it falls onto dispensing surface 90 (FIG. 5) located below the playfield whence it is directed to dispensing door 16.

Meanwhile the ball indicated at 14*a*, after falling as indicated by arrow 85, falls onto a slanting portion 89 extending from side 57 (FIGS. 7 and 8) as indicated at 14*g* and is deflected in the direction indicated by arrow 88 to the position indicated at 14*h* whence it may fall through hole or opening (not shown) in playfield 27 (FIG. 5) to reach dispensing surface 90.

The fact that the ball is supported at 14*a* in chamber 55 which is provided by immovable walls, which cannot be moved or removed by accident and the security of which cannot be changed except by the sole action of disengaging latch 70 by the sole action of hitting the target ensures that no amount of shaking the machine or tilting it, even to very extreme degrees, will cause or allow a ball to be dispensed as if it were a prize by any means other than success at playing the game.

Thus means are provided to prevent an unwanted result of tilting the machine by raising its front end or rear end or either side to a substantial extent.

Playfield 27 may be provided with objects which extend upward from surface 26 to serve as obstacles or barriers to rolling movement of a ball on surface 26 in well known manner, such as shown at 91 in FIG. 7 in the parent application referred to above or at 260 (FIG. 18) of said application. Openings similar to hole 82 may likewise be provided in playfield 27 as shown at 93, 94 and 95 (FIGS. 7 and 18) in said application.

Whether or not the ball encounters any such obstacle it may encounter one of flippers 19 or the player may be able to so move one of flippers 19 by manual manipulation of switches controlled by buttons 18 so that the flipper hits the ball and deflects it from its previous path.

If the ball in play is not first driven against target 80 so that it falls through hole 82, it will sooner or later encounter a hole in the playfield as shown at 93, 94 or 95 in said application and drop through that hole onto dispensing surface 90 whereupon it will no longer be available for any play and will roll downward on surface 90 until it reaches the position indicated at 14*f* in FIG. 11 of said parent application, in contact with the inner surface of door 16. The player can then obtain the ball by opening door 16 and letting the ball fall out into the player's hand.

If the player is successful in causing one of flippers 19 to contact the ball he may be able, by suitable operation of the flippers using buttons 18, cause the ball to hit the target to cause another ball to be released as a prize in the manner herein described.

Figure 9:
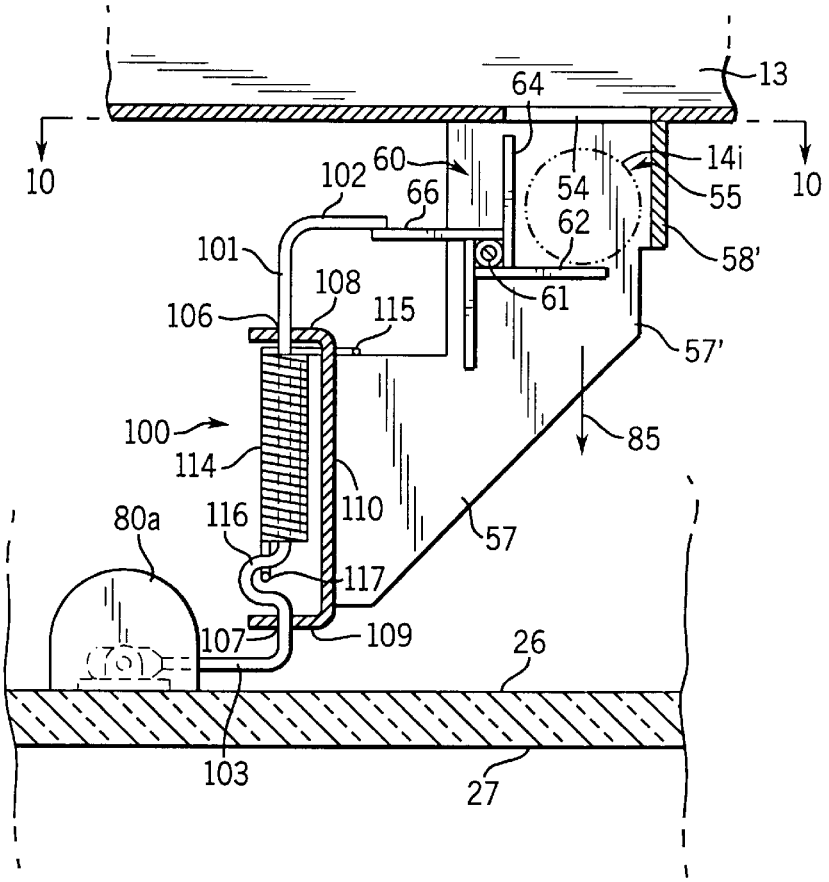
FIG. 9 is a view corresponding to that of FIG. 7, showing a modification of the latch mechanism of FIG. 7.
Figure 10:
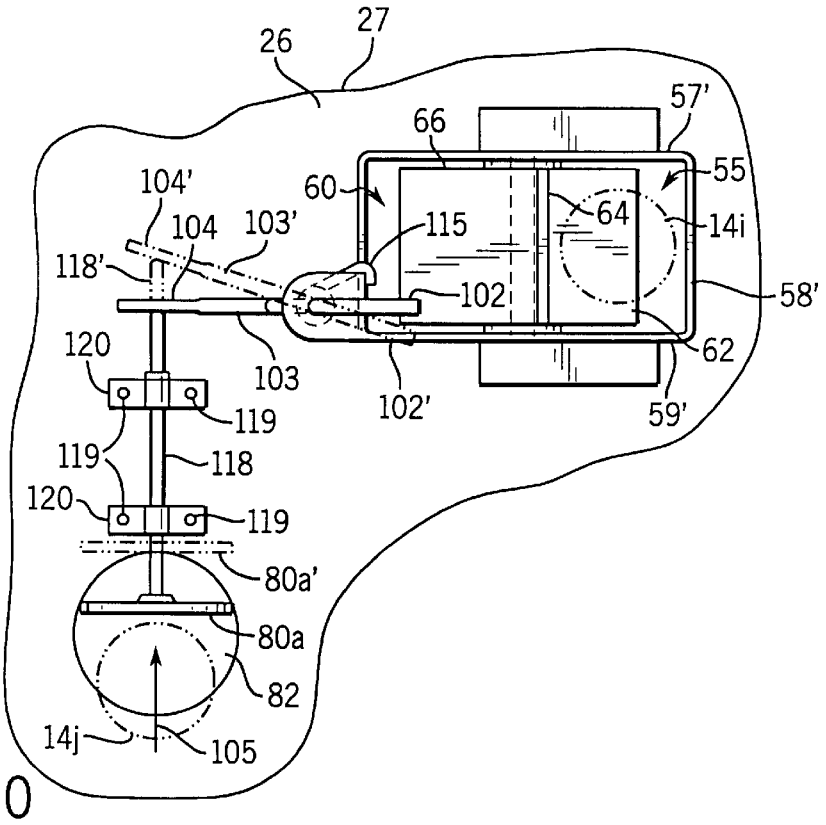
FIG. 10 is a cut-away plan view of the mechanism of FIG. 9 taken on lines 10—10 in FIG. 9.

As an alternative to latch mechanism 70 of the embodiment of FIGS. 5 to 8 as heretofore described, there may be provided an entirely different latch mechanism as shown in FIGS. 9 and 10.

Wheel 60 may act in conjunction with stationary sides 57', 58' and 59' to provide temporary holding chamber 55 which may hold ball 14*i* resting on blade 62 and retained thereon by blade 64 acting together with the stationary sides.

Latch 100 may include vertically extending rotatable portion 101 having laterally extending portion 102 which may engage blade 66 in such manner that when part 101 is rotated, portion 102 is moved to the position indicated at 102' to disengage from blade 66 in such manner that when part 101 is rotated, portion 102 is moved to the position indicated at 102' to disengage from blade 66 whereby wheel 60 may rotate and drop ball 14*i* as indicated by arrow 85.

Portion 101 may extend rotatably through holes 106 and 107 in tabs 108 and 109 which may extend from member 110 attached to side 57.

Coil spring 114 may surround a portion of part 101 between tabs 108 and 109 and may have one end extended in the form of a hook to engage tab 108 at 115. A bend may be provided in part 101 at 116 with which the other end 117 of spring 114 may be engaged.

Below hole 107, a laterally extending portion 103 of member 101 may be provided which may terminate in flattened portion 104.

A drive rod 118 may be attached to target 80*a*, which may correspond to target 80, and may be slidingly received in mounting members 120 which may be attached with rivets, bolts or screws at 119 to playfield 27.

Thus when a ball 14*j* rolling on surface 26 in the direction indicated by arrow 105 strikes target 80*a*, the target may be driven to the position shown at 80*a'* and rod 118 may be slidably moved to the position shown at 118' and may act against flattened portion 104 to move it to the position shown at 104' to move portion 103 to 103' and cause rotation of 101 against the action of spring 114 to cause portion 102 to disengage with blade 66 as indicated at 102'.

Figure 11:
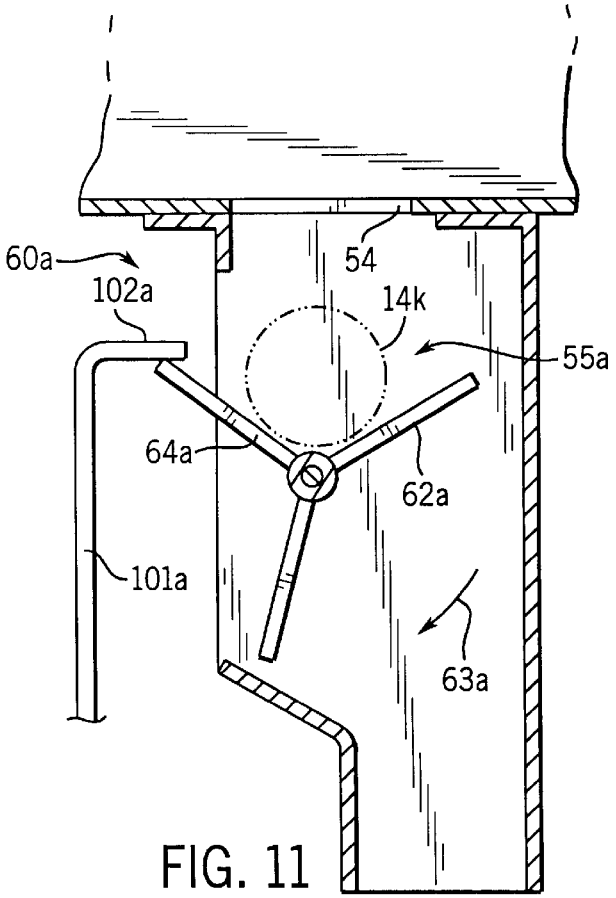
FIG. 11 is a cross sectional view corresponding to that of FIG. 7, showing a modification of the mechanism of FIG. 7.
Figure 12:
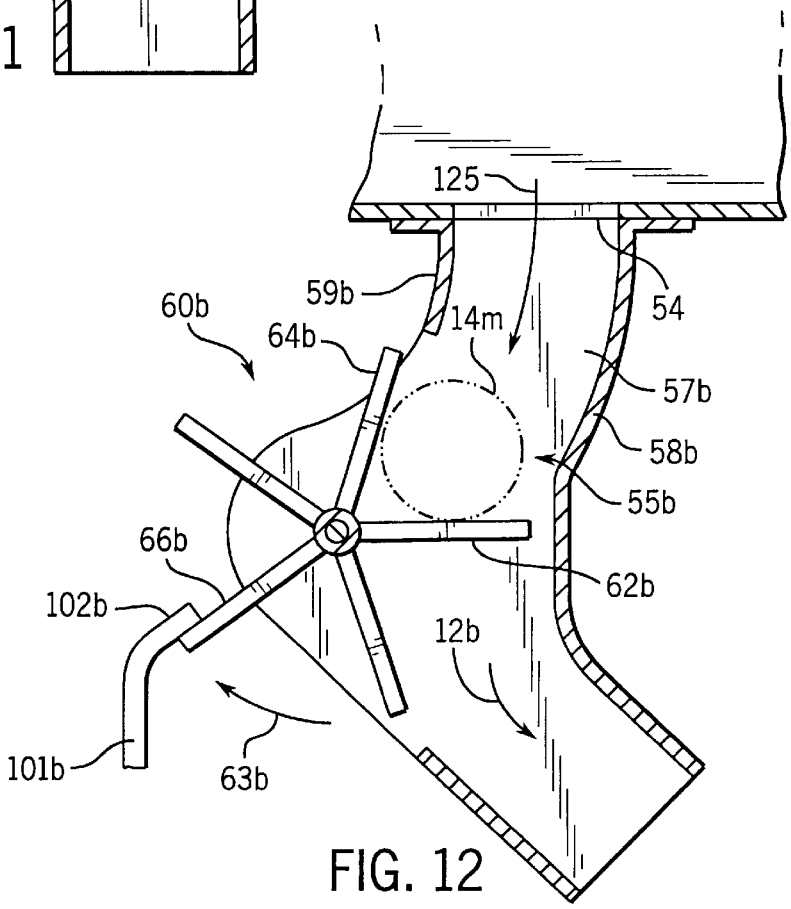
FIG. 12 is a cross sectional view corresponding to that of FIG. 11, showing a modification of the mechanisms of FIGS. 7 and 11.

Wheel 60 need not have 4 blades as indicated in FIGS. 11 and 12 wherein wheel 60*a* is indicated as having 3 blades and wheel 60*b* is indicated as having 5 blades.

Thus in FIG. 11 ball 14*k* is shown resting against blade 62*a* in holding chamber 55*a*. Another blade 64*a* serves to provide another wall to coact with stationary sides 57, 58 and 59 (not shown) to provide chamber 55*a*. End 102*a* of vertically extending rotatable member 101*a* may engage and disengage with blade 64*a* as shown for member 102 acting against blade 66.

When wheel 60*a* is in the non-rotating position as shown, blade 62*a* extends more nearly horizontal than does blade 64*a* and blade 64*a* extends more nearly vertical than does blade 62*a*, so that a greater amount of the weight of ball 14*k* is carried by blade 62*a* than by blade 64*a* and wheel 60*a* is urged to rotate in the direction indicated by arrow 63*a*. When member 102*a* is disengaged with blade 64*a*, the wheel 60*a* rotates as indicated by arrow 63*a* and ball 14*k* drops.

Referring to FIG. 12, wheel 60*b* has 5 blades and ball 14*m* rests on blade 62*b*. Blades 62*b* and 64*b* coact with stationary parts 57*b*, 58*b*, and 59*b* to provide holding chamber 55*b*.

Latch end 102*b* extending from latch member 101*b* engages blade 66*b* and illustrates that the latch need not act on a blade which forms a wall of the holding chamber or a blade extending opposite thereto but may engage with any blade on the wheel.

Ball 14*m* may enter chamber 55*b* as indicated by arrow 125. When latch end 102*b* is disengaged from blade 66*b*, wheel 60*b* rotates as indicated by arrow 63*b* and ball 14*m* exits chamber 55*b* as indicated by arrow 126.

It may be observed that in the embodiments of FIGS. 9 and 10 the horizontal axis of the wheel extends parallel to the axis of a ball which approaches the target on a course normal to the target surface and extends longitudinally with respect to the entire machine and normal to the direction of reciprocation of bar 30. The invention is not limited to the direction in which the wheel axis extends.

Figure 13:
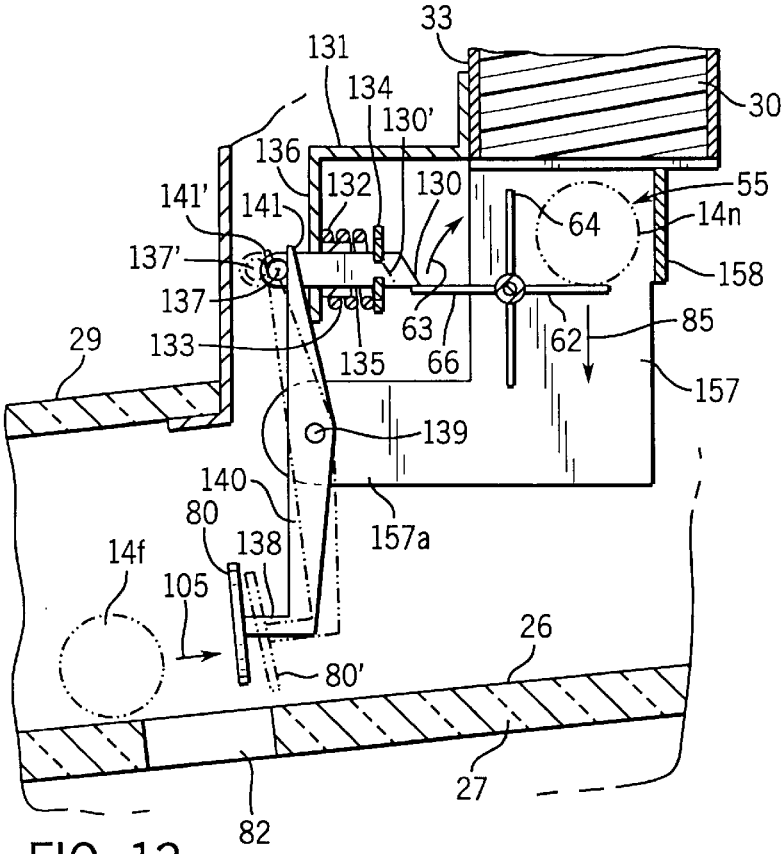
FIG. 13 is a cross sectional view corresponding to that of FIG. 7, showing a modification of the latch of FIG. 7.

Referring to FIG. 13, bracket 131 may be attached to a portion of tube 33 and may have portions 132 and 133 extending laterally therefrom which may slidingly receive latch member 130.

Latch member 130 may be provided with a stop-member 134. Compression spring 135 may be received around members 132 and 133 to act between portion 136 of bracket 131 and stop-member 134 to urge latch member 130 outwardly to engage blade 66 of wheel 60 which may have blades 64 and 62 positioned to co-act with stationary portions such as 157 and 158 to provide holding chamber 55 containing ball 14*n* which may rest on blade 62 to urge wheel 60 to rotate in the direction indicated by arrow 63.

Latch member 130 may have a pin 137 extending laterally. Actuating member 140 may be pivotally mounted at 139 on extending portion 157*a* of side 157 and may have target 80 attached to a target receiving portion 138 and may have an upwardly extending portion 141 engaging pin 137 so that when a ball traveling as shown at 14*f* in the direction indicated by arrow 105 strikes target 80, target 80 will be moved to the position indicated at 80' and portion 141 will act against pin 137 to move latch 130 so these parts will be moved to the positions indicated at 141', 137' and 130', thus disengaging latch 130 from blade 66 and permitting ball **14*n* to be dispensed as indicated by arrow 85 past playfield 27 by an unshown passage directly to dispensing surface 90**.

Figure 14:
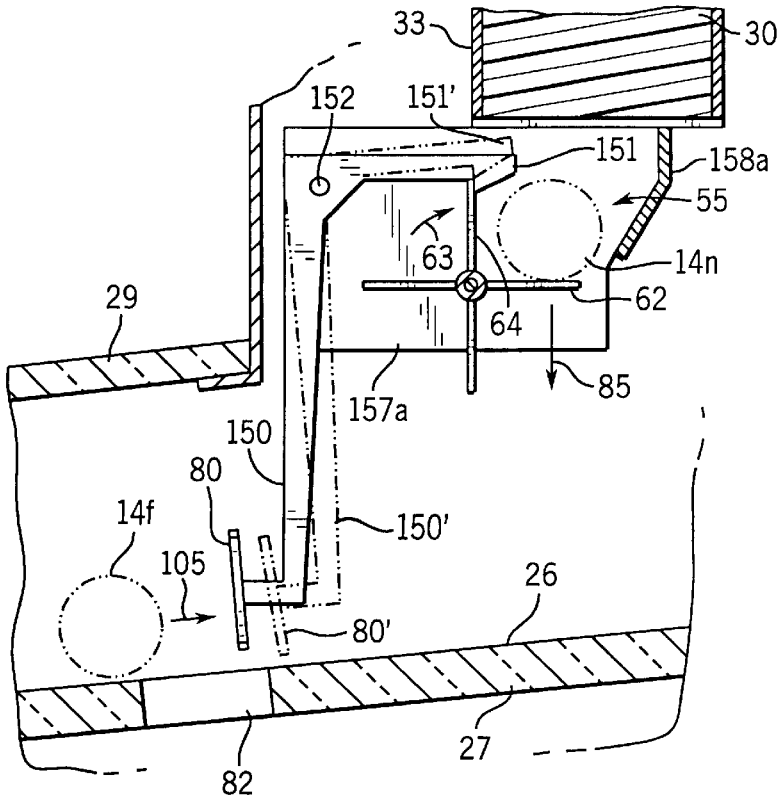
FIG. 14 is a cross sectional view corresponding to that of FIGS. 7 and 13, showing a modification of the latch of FIG. 7.

Another latch mechanism is shown in FIG. 14 wherein a tooth 151 of latch member 150 engages blade 64, one of the blades which defines chamber 55 which is otherwise defined by blade 62 on which ball **14*n* rests and by stationary walls 157*a* and 158*a*** and one or more additional stationary walls not shown.

Latch member 150 is pivotally mounted on pin 152 extending laterally from wall **157*a*. Target 80 is attached to a downwardly extending portion of latch member 150. Latch member 150 is urged by the action of a spring not shown, into the position shown in full lines wherein tooth 151 is engaged with blade 64**.

When target 80 is struck by a ball **14*f* traveling as indicated by arrow 105, it is moved to the position indicated at 80' and latch member 150 is moved to the position shown at 150' so tooth 151 is moved to position 151' and disengaged with blade 64, so wheel 60 is turned in the direction indicated by arrow 63 and ball 14*n* is dropped as indicated by arrow 85** Thus the latch may be very simple and may engage a blade of the wheel which coacts to define the holding chamber.

Figure 15:
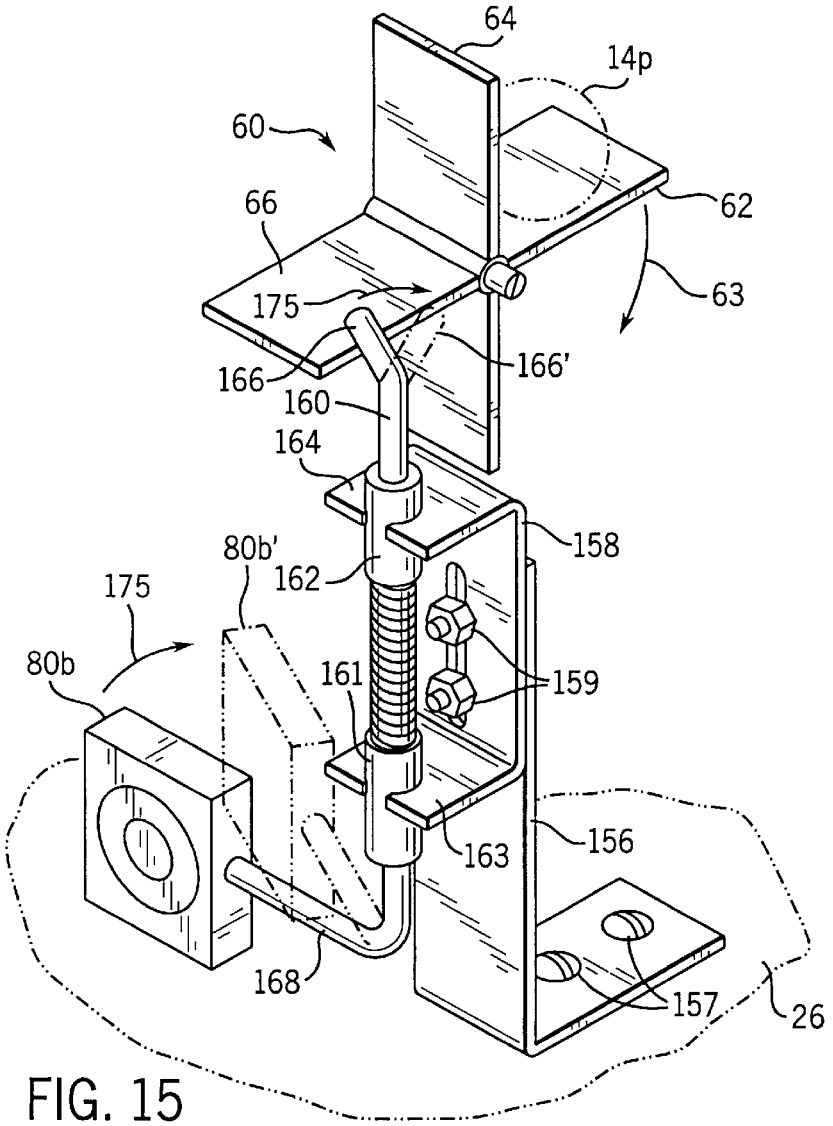
FIG. 15 is a cut-away perspective view, corresponding to that of FIG. 6, showing a modification of the latch of the embodiment of FIGS. 6 and 7.

In FIG. 15 here is shown an embodiment in which the target moves around a vertical axis instead of a horizontal axis. A bracket 156 is mounted by screws 157 to playfield surface 26. A support member 158 may be slidingly adjustably attached to bracket 156 by bolts or studs having nuts 159. A latch member 160 may be received in bearing members 161 and 162 received in tabs 163 and 164 extending from support member 158 so that latch member 160 may rotate on a vertical axis.

A part of member 160 may extend laterally at 166 to engage blade 66 of wheel 60 to prevent rotation of the wheel in the direction indicated by arrows 175 as urged by the weight of ball **14*p* acting on blade 62. Another part of member 160 may extend laterally at 168 and have target 80*b*** attached thereto.

When a ball strikes target **80*b* from a suitable direction, it may be moved in the direction indicated by arrows 175 to the position 80*b*' and portion 166 may be correspondingly moved to position 166' and disengaged from blade 66 and then wheel 60 may rotate in the direction of arrow 63 due to the weight of ball 14*p***, thus releasing the ball.

Figure 16:
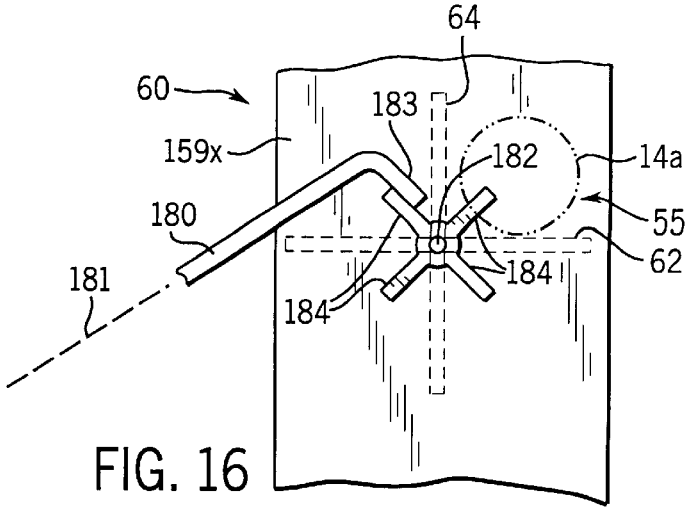
FIG. 16 is a fragmentary elevation showing a modification of the latch of FIG. 15.

In FIG. 16, there is shown a wheel 60, indicated in dashed lines behind a side **159*x*, which coacts with blades 64 and 62 and other stationary sides not shown to define a holding chamber 55 wherein ball 14*q* is supported on blade 62**.

The blades of wheel 60 may be attached to a rotating axle 182 which may extend through side **159*x* and have mounted thereon, outside and nearer to the observer than wall 159*x*, a plurality of index members 184**. The included angle between each index member and the next succeeding index member is made to be the same as the included angle between each blade of the wheel and the next succeeding blade.

A latch member 180 may he mounted to rotate on axis 181 and may be provided at its upper end with extending portion 183 which engages one of index members 184 as shown and which may be rotated to disengage with said member and upon return of latch member 180 to its original position to then engage with the following index member.

Thus in accordance with the invention it is not necessary for the latch to engage with a blade of the wheel. It may instead engage with an index member if index members are provided to correspond with the blades.

Whereas certain materials have been referred to above as being preferred for various parts of the machine, it is to be understood that all parts which come into the slightest contact with any of the balls are preferably to be made to "food-grade" standards as defined by pertinent regulations by all government agencies concerned since although the machine may be used for inedible objects such as rubber balls it is designed and intended for use with spherical or near-spherical spherical objects such as gumballs and hard candy balls which may be introduced into the mouth or ingested.

The details of the apparatus disclosed herein may be varied substantially without departing from the spirit of the invention or the scope of the claims and the exclusive use of such modifications as come within the scope of the claims and equivalents thereof is envisioned.

What is claimed is:

1. In a machine which comprises the combination of a reservoir to contain halls, a sloping playfield containing at least one hole large enough to allow passage of one of said balls downward therethrough, a sloping dispensing surface combined with a dispensing outlet so that balls which fall onto said dispensing surface roll to said dispensing outlet, a target member disposed to be struck and actuated by a ball in rolling play on said playfield, a coin mechanism, flippers mounted to make contact with a ball dropped onto said playfield to roll the ball on said playfield in order to attempt to cause the hall to strike and actuate said target, a separator to separate at least two halls from the remainder of balls in said reservoir, release means to provide a secondary holding chamber to receive one of the balls separated by said separator and to thereafter release it in response to actuation of said target, which comprises the combination of:

a wheel which comprises paddle-like blades, said wheel mounted to rotate on a substantially horizontal axis a latch member mounted to engage a member associated with said wheel to prevent rotation of said wheel so that a ball may be retained in supported relationship on one of the blades of the wheel, at least one stationary member extending alongside a portion of said wheel so that the blade supporting said ball and the following blade coact therewith to provide a temporary holding chamber to hold said ball, means to cause said latch member to become disengaged from said member associated with said wheel when said target is actuated by a ball which strikes it when in play whereby said wheel then rotates due to the weight of the the ball on said blade which supports it and the ball is released, and means to cause said latch member to engage a next succeeding member associated with said wheel as the wheel rotates to thereby stop rotation of the wheel until the target is again struck by a ball.

2. The combination of claim 1 wherein said member associated with said wheel is one of the blades of the wheel.

3. The combination of claim 1 wherein said member associated with said wheel is an index member attached to the wheel which is one of a plurality of index members corresponding in number and position to the positions of the blades of the wheel.

4. The combination of claim 1 wherein spring means is provided to urge said latch member into engagement with a member associated with the wheel.

5. The combination of claim 1 wherein said wheel comprises 4 blades.

6. The combination of claim 1 wherein said wheel comprises 5 blades.

7. The combination of claim 1 wherein said wheel comprises 3 blades.

* * * * *